US005776327A

United States Patent [19]

Botts et al.

[11] Patent Number: 5,776,327

[45] Date of Patent: Jul. 7, 1998

[54] METHOD AND APPARATUS USING AN ANODE BASKET FOR ELECTROPLATING A WORKPIECE

[75] Inventors: Robert R. Botts; Swati V. Joshi; Louis W. Nicholls, all of Durham, N.C.

[73] Assignee: Mitsubishi Semiconuctor Americe, Inc., Durham, N.C.

[21] Appl. No.: 732,655

[22] Filed: Oct. 16, 1996

[51] Int. Cl.[6] ..... C25D 5/00; C25D 17/10

[52] U.S. Cl. ..... 205/96; 204/228; 204/227; 204/DIG. 7

[58] Field of Search ..... 205/96, 97; 204/DIG. 7, 204/274 R, 228, 242, 279, 284, 287

[56] References Cited

U.S. PATENT DOCUMENTS

| | | | |
|---|---|---|---|
| 2,841,547 | 7/1958 | Kotz et al. | 204/223 |
| 3,862,891 | 1/1975 | Smith | 204/279 |
| 3,926,772 | 12/1975 | Cordone et al. | 204/283 |
| 3,954,569 | 5/1976 | Vanderveer et al. | 205/95 |
| 4,077,864 | 3/1978 | Vanderveer et al. | 204/285 |
| 4,322,280 | 3/1982 | Houska et al. | 204/207 |
| 4,401,523 | 8/1983 | Avellone | 204/15 |
| 4,933,061 | 6/1990 | Kulkarni et al. | 204/224 R |
| 5,147,050 | 9/1992 | Cullen | 211/118 |
| 5,281,325 | 1/1994 | Berg | 205/125 |

OTHER PUBLICATIONS

F.A. Lowenheim, *Electroplating*, McGraw-Hill Book Co., New York, 1978, pp. 152-155, 329-330. No month available.

*Primary Examiner*—Kathryn L. Gorgos
*Assistant Examiner*—William T. Leader
*Attorney, Agent, or Firm*—Lowe, Price, LeBlanc & Becker

[57] ABSTRACT

A method and apparatus are provided for electroplating a workpiece. The apparatus includes an anode basket containing particles of an electroplating material. A mask is positioned around the anode basket to selectively block current flow from the basket to the workpiece which is mounted to a cathode. The mask includes a frame supporting a number of non-conductive plates adjusted in position to provide a desired electrical field distribution. The resulting electrical field between the anode and the cathode produces uniform plating thickness over the entire surface of the workpiece.

18 Claims, 2 Drawing Sheets

METHOD AND APPARATUS USING AN ANODE BASKET FOR ELECTROPLATING A WORKPIECE

TECHNICAL FIELD OF THE INVENTION

The present invention relates to a method and apparatus for use in an electroplating process, and more particularly, to a method and apparatus for providing a uniform plating thickness by controlling the electric field produced by the anode of the electroplating apparatus.

BACKGROUND OF THE RELATED ART

During manufacture of semiconductor chips for mounting on printed circuit boards carrying the chips and other circuit components, the conductors of the chips are electroplated with a solder material comprising tin and lead to improve solderability of the chip to the board. The step of electroplating is typically performed while several semiconductor chips are mounted on a lead frame suspended by hooks on a cathode rack placed in a plating solution contained in an electroplating bath. The bath contains an anode which conducts an electrical current which passes to the cathode rack and lead frames to deposit metal on the lead frames, especially on the outer leads of the semiconductor chips. After electroplating, the lead frames are severed and the individual semiconductor chips are separated.

The thickness of the deposited metal is a function of the current density which in turn is a function of the current distribution that is primarily influenced by the geometry of the plating bath. The positive electrode in the plating bath, the anode, conducts the current into the plating solution and produces an electric field between the anode and the cathode (workpiece). The electric field influences the current distribution, and thus the thickness of the deposited metal, over the workpiece surface. Because the field strength of the electric field is greater near the edges of the workpiece than at the center of the workpiece, the electroplating thickness tends to be greater at the edges. To make plating thickness more uniform, it is necessary to produce an electric field that is uniform across the surface of the workpiece to prevent extraneous current flow toward the workpiece periphery.

A conventional electric field distribution that may be produced in an electroplating bath is schematically depicted in FIG. 3. The electric field 2 emanates from anode 3 toward cathode rack 4 supporting a workpiece 5. As a result of non-uniform field distribution, current is attracted to edges 6, 7 of workpiece 5. As a result, plating thickness tends to be greater at edges 6, 7 than at the middle 8 of the workpiece.

Various attempts have been made to improve distribution of plating materials on a workpiece. For example, U.S. Pat. Nos. 3,954,569 and 4,077,864 to Vanderveer et al. disclose an electroforming method and apparatus including an anode basket housing nickel chips and covered by non-conductive shields. The shields include a cut-out to expose a predetermined area of the anode to the workpiece cathode. By reducing the exposed anode area, a higher tank voltage can be utilized. A disclosed advantage of the anode shields of Vanderveer et al. is to improve ductility of the electroformed surface by increasing the anode current density while maintaining the higher voltage level. However, the shield does not control the electric field for unifying the plating thickness over the entire surface of the workpiece.

Another example of an anode shielding apparatus is disclosed in U.S. Pat. No. 3,862,891 to Smith, in which parallel non-conductive surfaces are positioned upwardly from and along two sides of the anode surface. The non-conductive surfaces are intended to maintain a uniform plating current distribution without interfering with the free flow of electrolyte solution through the electroplating tank. However, the disclosed apparatus does not permit adjustment of the electrical field emanating from the anode to control plating thickness.

SUMMARY OF THE DISCLOSURE

Accordingly, a principal object of the present invention is to provide an improved electroplating apparatus and electroplating method that produces a uniform plating thickness along over the entire surface of a workpiece.

Another object is to provide an improved electroplating apparatus effectuating a uniform electric field between the cathode and anode to control the plating thickness over the entire surface of the workpiece.

Yet another advantage of the invention is in providing an improved electroplating apparatus and electroplating method which permit adjustment of the electrical field emanating from the anode to control the plating thickness over the entire surface of the workpiece.

SUMMARY OF THE DISCLOSURE

The above and other related objects of the invention are achieved, at least in part, by providing an improved apparatus for electroplating a workpiece with an electroplate metal. The apparatus according to a preferred embodiment comprises a cathode rack supporting the workpiece, and an anode including a basket in which anode particles are contained. A mask covers the basket to block a portion of the current emanating from the anode. This mask comprises a frame secured to the basket and at least one elongate non-conductive plate supported by the frame. The apparatus includes an electroplating bath in which the anode and the cathode rack including the workpiece are immersed, producing current emanating from the anode toward the cathode to deposit the electroplate metal on the workpiece.

The anode particles may be in the form of balls formed of a tin-lead alloy, gold, palladium, chrome, tin, or tin-palladium alloy.

The mask may include a plurality of elongate non-conductive plates individually and adjustably supported by the frame. Each plate may include at least one slot and the frame may include at least one projecting pin such that the pin is received in the slot and the plate can be adjusted relative to the slot to vary the location of the plate on the frame. By varying the location of the plate relative to the frame, the current emanating from the anode is advantageously manipulated to achieve the desired uniform deposit of plating material on the workpiece.

According to another preferred embodiment, the apparatus includes a second anode identical to the first anode, with the first and second anodes being disposed on opposite sides of the cathode to electroplate both sides of the workpiece.

In another aspect of the invention, there is also provided a method of electroplating a workpiece. A cathode rack bearing the workpiece is immersed in an electroplating bath. Selected portions of an anode basket containing anode particles, e.g., of a tin-lead alloy, are masked with at least one non-conductive plate. The anode basket is immersed in the bath, and current flow from the anode to the cathode deposits the anode material on the workpiece.

Preferably, the step of masking selected portions of an anode basket comprises covering the anode basket with a non-conductive frame, placing a plurality of non-conductive plates on the frame, and adjusting the position of each of the plurality of non-conductive plates on the frame to achieve a desired electric field distribution.

According to another embodiment of the present invention, an anode is provided for use in an electroplating apparatus that includes a cathode from which a workpiece is suspended in an electroplating bath. The anode comprises a basket containing anode particles. A non-conductive anode mask includes a frame removably secured to an outer surface of the basket and at least one non-conductive elongate plate secured to the frame. Preferably, the non-conductive plate is adjustably secured to the frame.

According to one aspect of the invention, the mask includes a plurality of elongate non-conductive plates, each adjustably secured to the basket.

Still other objects and advantages of the present invention will become readily apparent to those skilled in this art from the following detailed description, wherein only the preferred embodiments of the invention are shown and described, simply by way of illustration of the best mode contemplated of carrying out the invention. As will be realized, the invention is capable of other and different embodiments, and its several details are capable of modifications in various obvious respects, all without departing from the invention. Accordingly, the drawing and description are to be regarded as illustrative in nature, and not as restrictive.

DETAILED DESCRIPTION OF THE PREFERRED EMBODIMENTS

Although the present invention has general applicability in the field of manufacturing and assembly of integrated circuits, and specifically in the electroplating of the outer leads of semiconductor chips, it is to be understood that the present invention is also applicable for use with any electroplating apparatus and process in which achieving a uniform plating thickness is desired.

Figure 1:
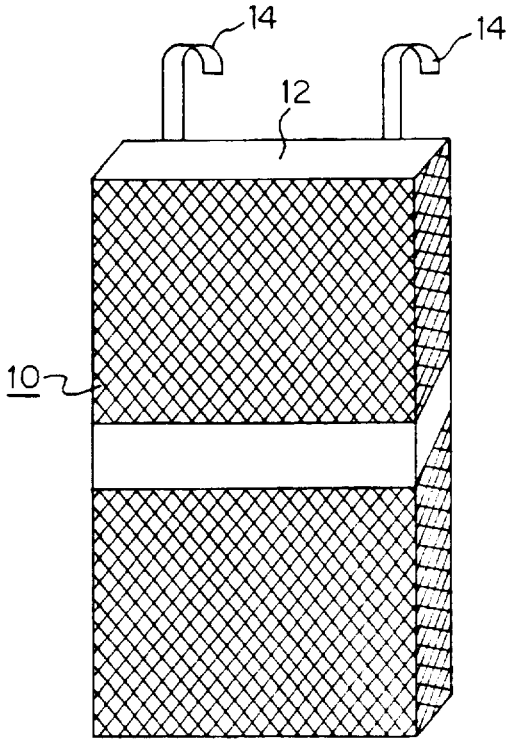
FIG. 1 is a perspective view of a typical anode basket.

Referring to FIG. 1 of the present invention, an anode basket 10 is generally rectangular in shape and is filled with anode particles (not shown), which may be made of a tin-lead alloy. These particles may be shaped as chips, balls or any other suitable shape. The anode particles may be of any other conventional electroplating materials, such as gold, palladium, chrome, tin or tin-palladium alloy. The top of basket 10 bears hooks 14 permitting the basket to be suspended from a frame or the side of a tank (not shown) and immersed a plating solution contained in an electroplating bath.

Figure 2:
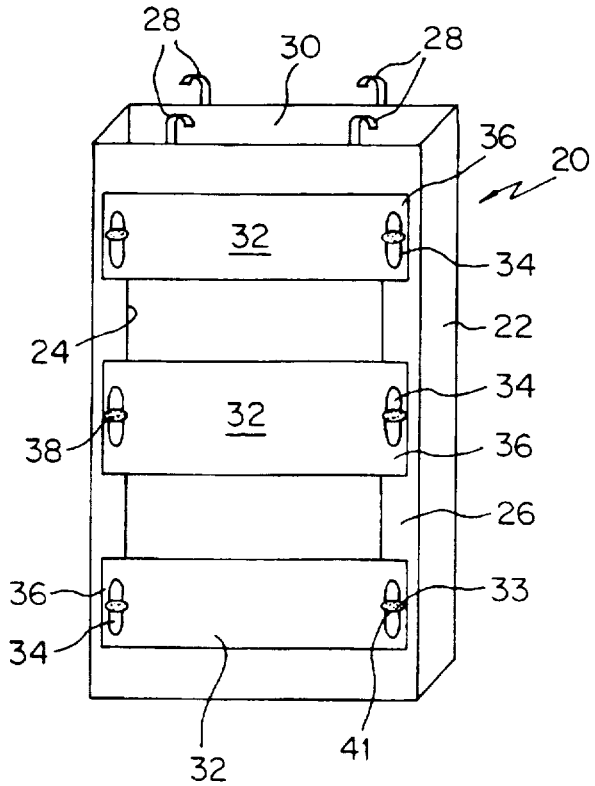
FIG. 2 depicts an anode mask according to the present invention.
Figure 3:
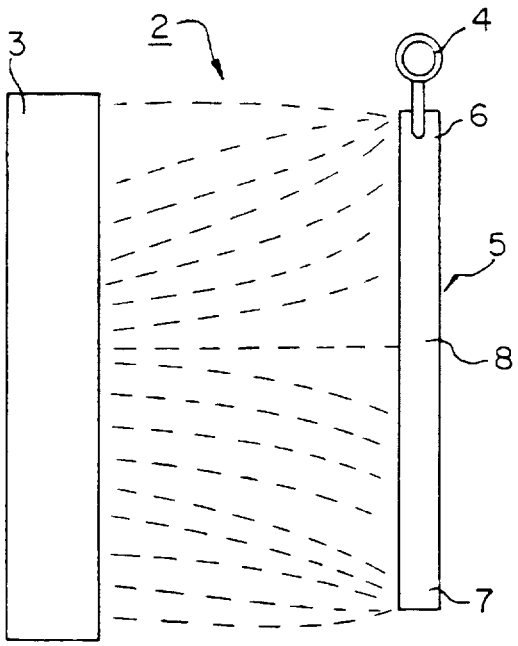
Figure 3 (PRIOR ART)
FIG. 3 is a schematic illustration of the electric field generated by an anode in electroplating apparatus which lacks the anode mask of the present invention.

As depicted in FIG. 2, an anode mask 20 is found to be of a shape generally conforming to the shape of anode basket 10 so that the basket may be placed within anode mask 20. A plurality of plates 32 are secured to anode mask 20 and serve to block portions of an electrical field emanating from basket 10. As will be discussed in more detail later, the resulting electric field emanating from anode basket 10 toward the cathode rack advantageously uniformly encounters the workpiece, thus achieving a uniform thickness of the deposited plating on the workpiece.

Referring to FIG. 2 in more detail, anode mask 20 includes a generally rectangular non-conductive frame 22 adapted to conform to the rectangular shape of basket 10 so that frame 22 may be positioned to surround the basket. Frame 22 includes a front surface 26 with an opening 24. The frame 22 may be secured to basket 10 in any suitable manner. For instance, anode mask 20 may be dimensioned to fit snugly over basket 10 so that a force is required to remove mask 20 from basket 10. Alternatively, as depicted in FIG. 2, frame 22 may include an open upper surface 30 through which the basket may be received inside the mask 20, with fastening strips 28 disposed on the front and rear of upper surface 30. Fastening strips 28 may be secured to one another in any conventional manner, such as with hook and loop fasteners, such that basket 10 is held in place within mask 20.

Adjustable plates 32 are secured to the front surface 26 of frame 22. Preferably, plates 32 are made of a non-conductive, chemical-resistant material. Each plate 32 is generally elongated and includes a vertically slotted hole 34 at each side 36. A plurality of turn pins 38 are disposed at various locations along front surface 26 of frame 22.

Figure 4:
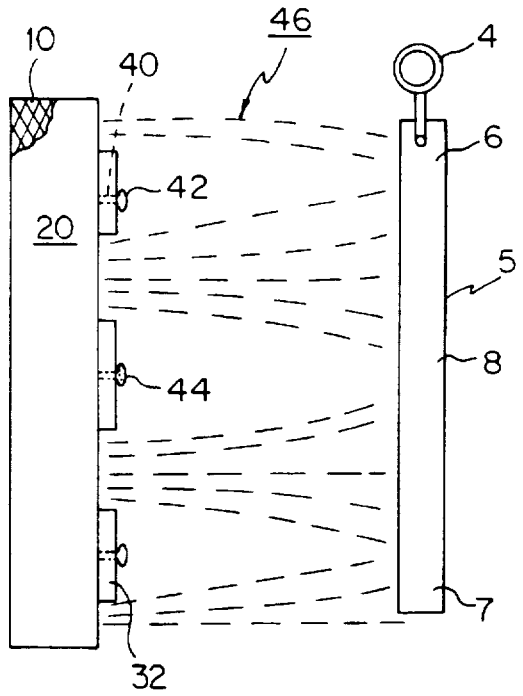
FIG. 4 is a schematic illustration of the electric field generated by an anode including the anode mask of the present invention.

More specifically, each turn pin 38 includes a shaft 40 and an elongated head 42. See FIG. 4. Preferably, elongated head 42 includes a knurled surface 44 to facilitate manual gripping. It will be appreciated by one skilled in the art that when elongated head 42 is rotated in alignment with slotted hole 34 of plate 32, the plate may be positioned over turn pin 38. Once plate 32 is positioned against front surface 26 of frame 22 with turn pin 38 at the desired location within slotted hole 34, the turn pin may be rotated approximately 90° so that elongated head 42 is at a right angle to slotted hole 34. Plate 32 is thus retained to frame 22, as shown in FIG. 2. The electric field resulting from the masked anode basket is schematically depicted in FIG. 4. Because plates 32 block selected portions of the current flowing from anode basket 10, the electric field 46 emanating from anode basket 10 toward cathode rack 4 tends to more uniformly encounter workpiece 5. Thus, the thickness of the deposited plating is correspondingly uniformly distributed over the surface of workpiece 5.

Figure 5:
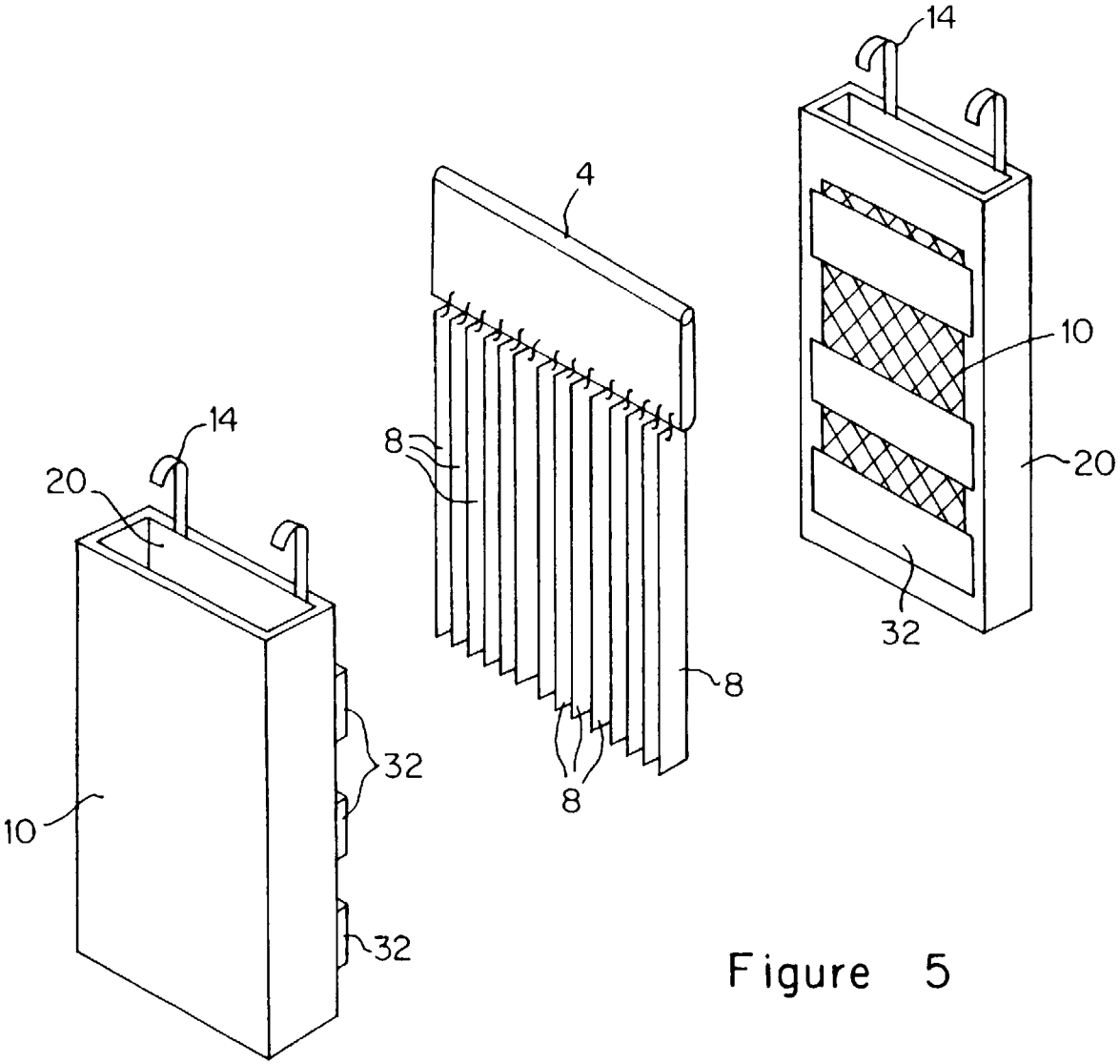
FIG. 5 is a perspective view of a second preferred embodiment of the present invention.

The outer leads of a semiconductor chip are usually electroplated on both sides. A second preferred embodiment, as generally depicted in FIG. 5, implements a pair of anode baskets 10, each with a mask 20 provided thereon as described above, disposed on opposite sides of the cathode rack 4 to permit the plating material from the anode to be deposited on both sides of the workpiece.

It can thus be seen that the present invention provides a unique apparatus for adjusting the electric field between the cathode and the anode of an electroplating apparatus. By adjusting the number and location of non-conductive plates 32 along frame 22, the electric field may be manipulated thereby to produce a desired electric field distribution.

Although the apparatus of the present invention has been described as altering the electric field to produce a uniform plating thickness across the entire workpiece, it will be appreciated by one of ordinary skill in the art that the apparatus disclosed herein may be utilized to produce a controlled variable plating thickness, as may be required for a particular application. It will be understood that these and obvious variations are within the scope of the present invention.

In this disclosure, there are shown and described only the preferred embodiments of the invention, but, as aforementioned, it is to be understood that the invention is capable of use in various other combinations and environments and is capable of changes or modifications within the scope of the inventive concept as expressed herein.

We claim:

1. An apparatus for electroplating a workpiece with an electroplating metal, comprising:

a cathode rack supporting the workpiece;

an anodes including a basket in which particles of the electroplating metal are contained; and a mask, comprising a frame configured to snugly fit over and be secured to the basket and at least one elongate non-conductive plate removably supported by the frame, wherein the cathode rack, anode and mask are all immersed in a plating solution and, when the apparatus is energized to produce an electric field emanating from the anode toward the cathode to generate a corresponding current to deposit the electroplating metal on the workpiece, the electric field is selectively blocked by the mask to achieve a desired electrical field distribution between the anode and the workpiece.

2. The apparatus of claim 1, wherein:

the at least one non-conductive plate is adjustably supported to the frame.

3. The apparatus of claim 1, wherein:

the electroplating metal anode particles comprise a tin-lead alloy.

4. The apparatus of claim 1, wherein:

the anode particles comprise balls formed of a tin-lead alloy.

5. The apparatus of claim 1, wherein:

the electroplating metal particles comprise a material selected from the group consisting of gold, palladium, chrome, tin, tin-lead alloy, and tin-palladium alloy.

6. The apparatus of claim 1, wherein:

the mask includes a plurality of elongate non-conductive plates.

7. The apparatus of claim 6, wherein:

the plurality of elongate plates are individually and adjustably supported to the frame.

8. The apparatus of claim 6, wherein:

each of the plurality of plates includes at least one slot and the frame includes at least one projecting pin, the at least one pin being received in the at least one slot of each said plate such that the location of the plates can be adjusted relative to the at least one pin to vary the location of each plate on the frame.

9. The apparatus of claim 1, wherein:

the anode is a first anode, the apparatus further comprising a second anode including a second basket in which additional electroplating metal particles are contained and a second mask at least partially surrounding the second basket, the second mask comprising a second frame secured to the second basket and at least one elongate second non-conductive plate supported to the second frame, the first and second anodes being disposed on opposite sides of the cathode to electroplate both sides of the workpiece.

10. A method of electroplating a workpiece, comprising the steps of:

(a) immersing the workpiece supported by a cathode rack in an electroplating bath;

(b) providing an anode basket containing anodes of a prescribed plating material;

(c) covering a portion of the anode basket with a non-conductive frame snugly fitted around the anode basket and having an opening facing the workpiece;

(d) connecting at least one non-conductive plate on the frame to mask a portion of the frame opening;

(e) adjusting the position of the non-conductive plate on the frame to achieve a desired electrical field distribution;

(f) immersing the masked anode basket in the bath; and (g) causing a current to flow between the anode and cathode to deposit the plating material on the workpiece.

11. The method of claim 10, comprising the further steps of:

mounting a plurality of non-conductive plates to the frame during step (d); and adjusting respective positions of the non-conductive plates on the frame to achieve a desired electrical field distribution between the cathode rack and the anode basket.

12. An apparatus for electroplating a workpiece with an electroplating metal, comprising:

a cathode rack supporting the workpiece;

a first anode, including a first basket in which particles of the electroplating metal are contained; and a first mask comprising a frame snugly fitting around and covering a portion of the first basket, the first mask further comprising at least one elongate non-conductive plate adjustably secured to the frame, wherein, when the apparatus is energized to produce a current emanating from the first anode toward the cathode to deposit the electroplating metal on the workpiece, the current is selectively blocked by the first mask to achieve a desired electrical field distribution between the first anode and the workpiece.

13. The apparatus of claim 12, wherein:

the first mask comprises a plurality of elongate non-conductive plates, each adjustably secured to the first basket.

14. The apparatus of claim 12, further comprising:

a second anode including a second basket in which other anode particles are contained and a second mask at least partially surrounding the second basket, the second mask comprising at least one elongate non-conductive plate adjustably secured to the second basket, the first and second anodes being disposed on opposite sides of the cathode to electroplate both sides of the workpiece.

15. For an electroplating apparatus including an anode and a cathode from which a workpiece is suspended, the anode and cathode being immersed in an electroplating bath, and a flow of current being provided between the anode and the cathode to deposit an electroplating metal on the workpiece, the anode comprising:

a basket;

particles of the electroplating metal, contained in the basket; and a non-conductive anode mask, including a frame snugly fitted around and removably secured to an outer surface of the basket and at least one non-conductive elongate plate removably secured to the frame.

16. The anode of claim 15, wherein:

the non-conductive plate is adjustably secured to the frame.

17. The anode of claim 15, wherein:

the mask comprises a plurality of elongate non-conductive plates, each adjustably secured to the frame.

18. A method of electroplating a workpiece, comprising the steps of:

(a) immersing the workpiece, supported by a cathode rack, in an electroplating bath;

(b) masking selected portions of first and second anode baskets fitted into respective frames each having an opening facing the workpiece with respective non-conductive plates removably and adjustably mounted over the respective frame openings, the first and second baskets each containing anode particles of a prescribed electroplating material;

(c) immersing the first anode basket in the electroplating bath on a first side of the cathode;

(d) immersing the second anode basket in the electroplating bath on an opposite side of the cathode; and (e) producing a respective current flow between each of the first and second anodes and the cathode to deposit the electroplating material on corresponding opposite sides of the workpiece.

* * * * *